United States Patent [19]

Mathis

[11] 4,001,899

[45] Jan. 11, 1977

[54] COMBINED SWIMMING AND THERAPY POOL

[76] Inventor: Cleo D. Mathis, 1808 Potrero Ave., South El Monte, Calif. 91733

[22] Filed: Sept. 22, 1975

[21] Appl. No.: 615,208

[52] U.S. Cl. ..... 4/172; 4/172.19; 4/172.16

[51] Int. Cl.[2] ..... E04H 3/16; E04H 3/18; F16L 22/02

[58] Field of Search ..... 4/172, 172.15, 172.17, 4/172.18

[56] References Cited

UNITED STATES PATENTS

| | | | |
|---|---|---|---|
| 3,140,550 | 7/1964 | Wayfield | 4/172.19 X |
| 3,829,911 | 8/1974 | Bishop | 4/172.17 |

*Primary Examiner*—Henry K. Artis
*Attorney, Agent, or Firm*—Robert C. Comstock

[57] ABSTRACT

Combined swimming pool and therapy pool comprising vertically directed walls forming a single pool having a swimming pool area and an adjacent contiguous therapy pool area. Jet water outlets are directed inwardly from one wall of the swimming pool area, whereby a user can swim in a substantially stationary horizontal position against the force of the water jets. The therapy pool has seats, with additional jets directed inwardly toward the seats. A vertically directed divider is removably mounted between the swimming pool area and therapy pool area, to close off the therapy pool area for separate heating.

5 Claims, 3 Drawing Figures

COMBINED SWIMMING AND THERAPY POOL

BACKGROUND OF THE INVENTION

1. Field of the Invention

The invention relates to a combined swimming and therapy pool.

2. Description of the Prior Art

At the present time, a therapy pool is customarily constructed adjacent to, but separate from a conventional swimming pool. Each is a separate unit, customarily with separate plumbing and heating equipment and connections, involving a substantially high cost for the user.

Conventional swimming pools are also customarily of large size in order to provide a substantial amount of water through which the user can swim.

SUMMARY OF THE INVENTION

The present invention provides a combined swimming and therapy pool, both comprising adjacent areas of a single pool unit.

In particular, the invention provides a combined pool of the type described in which the swimming pool area is of greatly reduced size in comparison to a conventional swimming pool. Instead of swimming in a conventional manner through still water, the user swims against the opposing force of a plurality of water outlet jets which propel water into the swimming pool area beneath its top surface. The swimmer can thereby swim in the same place, while swimming in a normal manner and achieving the same amount of exercise and recreation as if swimming in a conventional pool.

Means are preferably provided for separating the swimming pool area from the therapy pool area, so that only the therapy pool area need be heated when the pool is used merely for therapy purposes.

In is accordingly an object of the invention to provide a combined swimming and therapy pool having all of the advantages and benefits set forth above and described in further detail hereinafter in this specification.

Another object of the invention is to provide a combined pool which provides all of the features of a swimming pool and a therapy pool in a single installation which can be made at a far lower cost than conventional separate swimming and therapy pools.

A further object is to provide such a combined pool which may be placed above the ground in order to reduce the cost of installation. A cover may also be provided for the smaller pool at a substantially low cost in order to avoid pool safety fencing requirements.

The invention also comprises such other objects, advantages and capabilities as will later more fully appear and which are inherently possessed by the invention.

While there is shown in the accompanying drawings a preferred embodiment of the invention, it should be understood that the same is susceptible of modification and change without departing from the spirit of the invention.

DESCRIPTION OF THE PREFERRED EMBODIMENT

Figure 1:
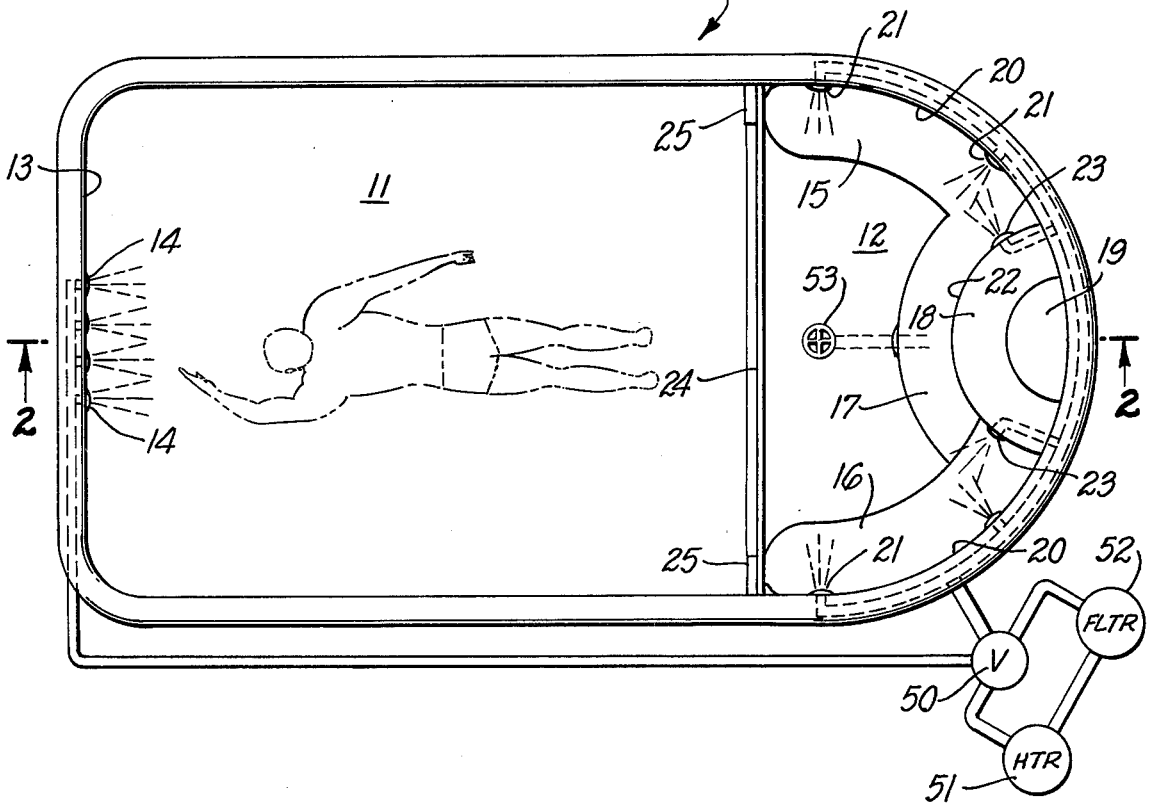
FIG. 1 is a top plan view of a combined swimming pool and therapy pool, with the plumbing control devices shown schematically and with the representation of a swimmer using the swimming pool area shown in phantom lines.
Figure 2:
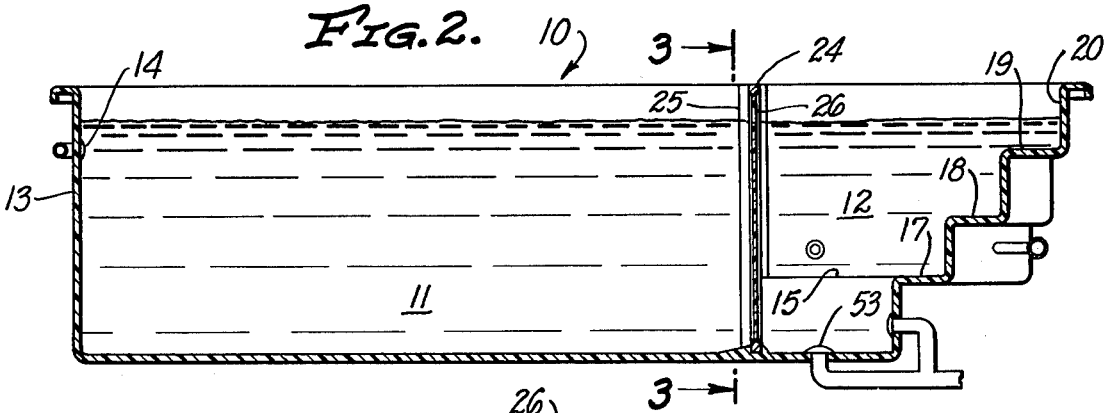
FIG. 2 is a longitudinal sectional view of the same taken on line 2—2 of FIG. 1.
Figure 3:
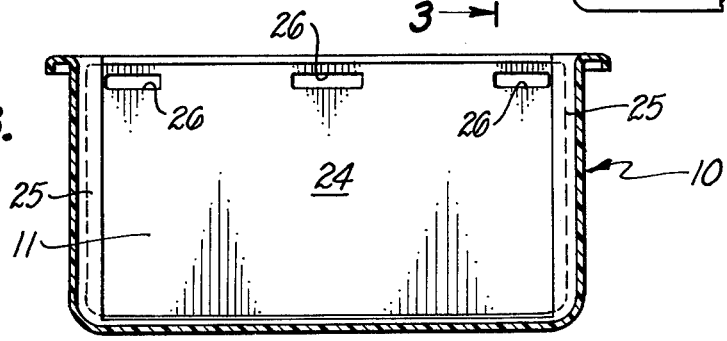
FIG. 3 is a transverse sectional view taken on line 3—3 of FIG. 2.

A preferred embodiment which has been selected to illustrate the invention comprises a single pool 10, which may be disposed above the ground or inserted into the ground with its upper surface at ground level, at the option of the user.

The pool 10 has a swimming pool area 11 at one end thereof and an integral contiguous therapy pool area 12 at the other end thereof. The depth of water in the swimming pool area 11 is preferably 36 inches, so that the user can swim within this area in a conventional manner.

The vertically directed wall 13 which defines the end of the swimming pool area 11 remote from the therapy pool area 12 is provided with a plurality of jet water outlets 14, which are disposed somewhat beneath the top surface of the water. The outlets 14 may be of any suitable type, such as shown in my U.S. Pat. Nos. 3,890,655-6. The outlets 14 should be constructed and arranged so that they move a considerable amount of water into the swimming pool area 11 in a direction normal to the wall 13, so that the user can swim against the force of the incoming water and receive a normal amount of exercise while remaining in substantially the same place within the swimming pool area 11.

It is accordingly possible for the swimming pool area 11 to be extremely short and narrow in comparison with the dimensions of a conventional swimming pool. For example, the entire pool 10 may have a length of approximately 14 feet and a width of approximately 8 feet. The overall depth of the pool may be approximately 3½ feet.

The therapy pool area 12 is semi-circular in contour and is preferably provided with seats 15 and 16 which are disposed on opposite sides of semi-circular steps 17, 18 and 19. The seats 15 and 16 are preferably of different heights from the bottom of the pool, so that the user can select his desired position with respect to the water level.

The wall 20 of the therapy pool area 12 is provided with a plurality of water outlet jets 21 which project heated water with force against the bodies of persons sitting on the seats 15 and 16 or otherwise disposed within the therapy pool area 12. The inside vertically directed wall 22 of the step 18 may also be provided with similar outlets 23 for the same purpose.

A divider 24 may be provided for removable use in a vertical position to separate the therapy pool area 12 from the swimming pool area 11. The divider 24 may be slidably mounted on suitable track means 25 disposed adjacent to the inner end of the steps 15 and 16.

The lower portion of the divider 24 is completely closed, so that when the divider 24 is in use, only the therapy pool area 12 need be heated. This provides for more rapid heating and for reducing heating cost. The top of the divider 24 is preferably provided with a plurality of openings 26 to permit overflow of water through the openings 26 to keep substantially the same level in both areas 11 and 12.

In use, it is possible to use either area of the pool or to use both areas at the same time. The invention provides a single pool which furnishes all of the benefits of a swimming pool and a therapy pool at a much lower cost. The pool may be provided with a removable cover, if so desired. The cost of such a cover is reduced because of the smaller area to be covered. Use of a cover may avoid the necessity of complying with safety fencing requirements.

Heating means of a conventional type are provided for heating water entering the pool through the outlets. Recirculation means of a conventional type are also provided for constantly recirculating the water. Both such devices are not described in detail because they are conventional in their structure and operation and well known to those skilled in the art.

Typical plumbing arrangements are shown schematically in FIG. 1 of the drawings. A six-way valve 50 controls water from a conventional source under pressure. A heater 51 and filter 52 are provided. A drain 53 in the bottom of the therapy pool area 12 is connected to a drainpipe for recirculation of the water.

The openings 26 in the top of the divider 24 may also be used as hand grips for installing and removing the divider 24.

I claim:

1. A swimming pool having a length only slightly greater than the length of the human body, said pool having a substantially vertical wall at one end thereof, jet water outlet means directed horizontally inwardly from said vertical wall, said jet water outlet means being constructed and arranged to move water into said swimming pool in a horizontal direction with sufficient force so that a user can swim for an extended period of time in a substantially stationary horizontal position within said swimming pool in the opposite direction against the force of the water entering said pool from said jet water outlet means, and a therapy pool disposed directly adjacent to said swimming pool, said swimming pool and therapy pool comprising adjacent areas of a single pool, said therapy pool being of shallower depth than said swimming pool, said therapy pool having horizontally directed seat means and second jet water outlet means directed substantially horizontally toward said seat means.

2. The structure described in claim 1, and means for selectively heating the water flowing into said swimming pool and therapy pool.

3. The structure described in claim 2, and valve control means for separately operating each of said two jet water outlet means.

4. The structure described in claim 3, and a vertically directed divider removably mounted between said swimming pool and said therapy pool, said divider closing off said therapy pool for heating said therapy pool separately from said swimming pool.

5. The structure described in claim 4, said divider having openings in the upper portion thereof to permit the overflow of water from said therapy pool into said swimming pool.

* * * * *